US005231775A

United States Patent [19]

Trent, Jr.

[11] Patent Number: 5,231,775

[45] Date of Patent: Aug. 3, 1993

[54] SPIKED BOOT FOR TREE CLIMBING

[76] Inventor: Ray Trent, Jr., 12933 Berlin St., Poway, Calif. 92064

[21] Appl. No.: 749,195

[22] Filed: Aug. 23, 1991

[51] Int. Cl.[5] ..... A43B 3/00; A63B 27/02

[52] U.S. Cl. ..... 36/113; 36/62; 182/221; 182/134

[58] Field of Search ..... 36/62, 66, 7.1 R, 113; 182/134, 221

[56] References Cited

U.S. PATENT DOCUMENTS

| | | | |
|---|---|---|---|
| 938,905 | 11/1909 | Speerstra | 182/221 |
| 2,357,159 | 8/1944 | Bennington | 182/221 |
| 3,025,927 | 3/1962 | Stein | 182/221 |
| 3,297,105 | 1/1967 | Lawrence | 182/221 |
| 3,867,998 | 2/1975 | Joseph | 182/221 |
| 4,153,139 | 5/1979 | Houch | 182/134 |
| 4,198,771 | 4/1980 | Foster | 36/66 |
| 4,524,530 | 6/1985 | Greenway | 36/62 |
| 4,530,420 | 7/1985 | Hobbs | 182/221 |
| 4,623,037 | 11/1986 | Kincaid | 182/134 |
| 4,679,658 | 7/1987 | Demers | 182/221 |
| 4,730,702 | 3/1988 | Torbett | 182/221 |
| 4,875,550 | 10/1989 | Rullo | 182/221 |
| 4,938,313 | 7/1990 | Rullo et al. | 182/134 |
| 4,993,515 | 2/1991 | Green et al. | 182/134 |
| 5,016,734 | 5/1991 | Greenway | 182/134 |

*Primary Examiner*—Steven N. Meyers
*Attorney, Agent, or Firm*—Ralph S. Branscomb

[57] ABSTRACT

A unit for mounting a tree-climbing spike to the lower leg and foot of the user comprises a comfortable, padded shell which wraps around the lower leg, ankle and foot of the user, with the lower portion of the unit being open at the front and heel, with only a stirrup to support the arch of the foot so that the user may use the unit while wearing boots, tennis shoes, or whatever else he happens to be wearing. The semi-flexible portion of the shell wraps around the lower leg and is secured by quick-release friction buckles, and on the inside wall of the shell is a spike mount which releasably mounts one of a set of spikes of different spur lengths to accommodate different tree types.

5 Claims, 1 Drawing Sheet

Fig. 1
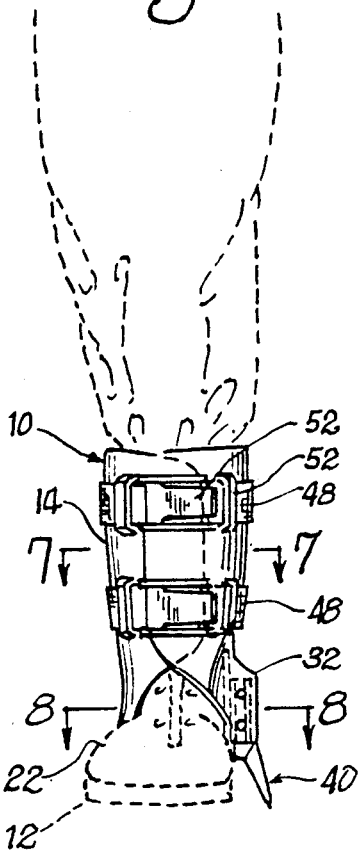
Fig. 2
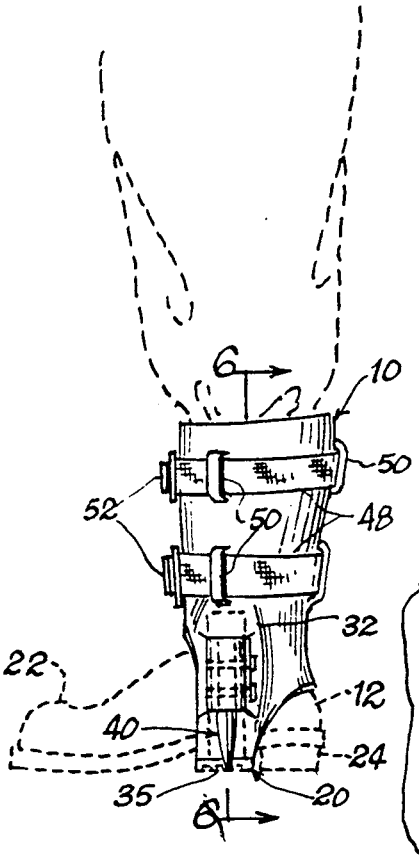
Fig. 3
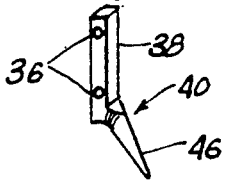
Fig. 4
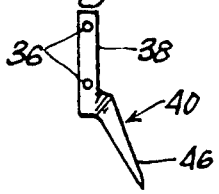
Fig. 5
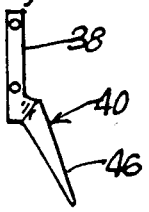
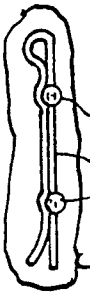
Fig. 10
Fig. 6
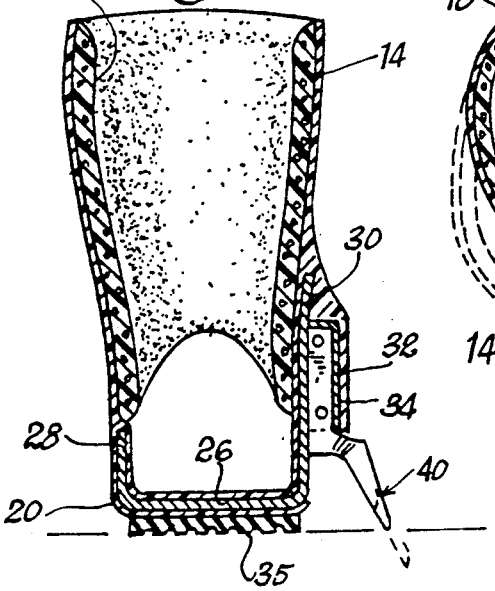
Fig. 7
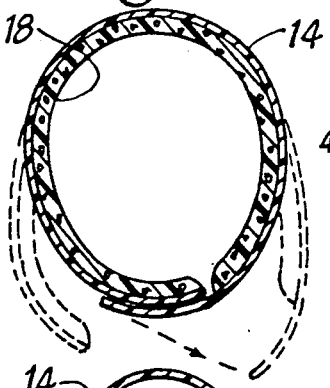
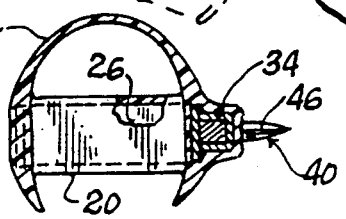
Fig. 8
Fig. 9
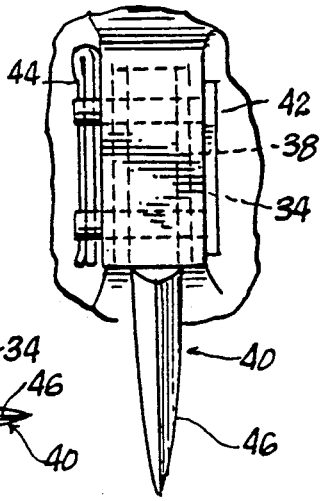

SPIKED BOOT FOR TREE CLIMBING

BACKGROUND OF THE INVENTION

Tree surgeons, tree trimmers and sometimes utility workers are required to climb trees and utility poles using a belt which wraps around the tree or pole and spikes which are inwardly directed from the lower portion of their boots to dig into the wood of the tree through the bark. To mount the spike onto the boot, workmen currently use an iron bar that is shaped something like fish hook, descending the inside of the leg and wrapping around the arch, with a spike mounted at the lower inside corner and straps which retain the unit to the lower leg and foot.

The problem with this spike mounting unit, which has been used for more than a hundred years, is not in its safety. It is a very safe unit which has proven to be substantially hazard-free in an intrinsically risky business. However, a major problem lies in its comfort. Even though the upper inside portion of the iron bar is padded, it nonetheless rubs continuously against a portion of the leg of the worker, usually through a boot, to produce an aggravated sore spot. Workers have been known to tape a piece of plywood covered with carpet over the existing pad to expand the area of contact between the boot and the spike mount. Such home-fix-it approaches assist somewhat on the comfort side, but still do not provide a complete and adequate solution and run the risk of degrading the spike mount from a safety point of view.

In addition, the nature of the existing spike mount is such that only a single spike, which is integral with the steel of the entire spike mount, can be used with any one spike mount. Because the bark of trees differ greatly in thickness, the spike mount must be provided in at least three different sizes as presently used. The spike mount is thus produced with spikes having three different sizes, one inch, one and one half inches and two inches.

There is a need for a comfortable spike mount which a worker can wear all day without creating abrasions of the leg and foot, and preferably one which would provide for the interchangability of spike elements so that different sized spikes may be work with the same spike mounts.

SUMMARY OF THE INVENTION

The spike mount of the instant invention fulfills the above stated need by providing a comfortable boot-like mount which releasably mounts one of a set of interchangeable spikes of different lengths.

The main boot or shell portion is made of tough, semi-flexible plastic, which is lined with a very comfortable, soft foam or other padding material. The shell is wrapped around the ankle and bottom portion of the leg, and retained to the lower leg with quick-release buckles on belts which encircle the upper portion of the shell.

The lower portion of the mount comprises a stirrup which passes down around the arch of the foot, and terminates on the inside in a steel lining for a downwardly-directed spike socket which releasably mounts one from the set of spikes of varying lengths.

BRIEF DESCRIPTION OF THE DRAWINGS

FIG. 1 is a front elevation view of the unit in use on the lower leg, ankle and foot of a worker, shown in phantom;

FIG. 2 is a side elevation view from the right side of FIG. 1;

FIG. 3 is a perspective view of a one inch spike;

FIG. 4 is a side elevation view of a one-and-one-half inch spike;

FIG. 5 is a side elevation view of a two inch spike;

FIG. 6 is a transverse section taken through the boot taken along line 6—6 of FIG. 2;

FIG. 7 is a horizontal section taken across the upper portion of the boot along line 7—7 of FIG. 1;

FIG. 8 is a horizontal section taken across the boot along line 8—8 of FIG. 1; and, FIG. 9 is an elevational view of a detail of the boot, illustrating the downwardly-directed socket which mounts the spur and the way in which the spur shank is releasably retained within the socket.

DETAILED DESCRIPTION OF THE PREFERRED EMBODIMENT

The spike mount is in the form of a boot 10, but is not referred to hereafter or in the claims as a boot so as not to confuse it with the boot 12 of the worker. The spike mount unit has as its principal member a shell 14 which is somewhat akin to the shell of a ski boot. The shell is made of very tough but semi-flexible material, as it has to expand or open to accommodate the foot of the user, which is accomplished in the illustrated embodiment by means of the open front 16 of the boot, which expands as shown in FIG. 7 to permit the user to insert his own boot or tennis shoe or whatever he is wearing inside the shell. The terms "inside" and "outside" refer to the two sides of the outside of the unit, whereas the term "interior" refers to the actual inside of the boot in which the foot is inserted.

As shown in FIGS. 6 and 7, the shell has a relatively thick, soft interior lining 18 of foam or some other soft, resilient material. Although it would not be absolutely necessary for this material to pass around the entire interior of the upper portion of the shell when it is closed as shown in FIG. 7, this is highly desirable. One of the principal purposes of the instant invention is to provide a spike mount unit which is comfortable enough for the user that it can be worn all day without creating sore areas or abrasions. This would be indicative of an interior foam lining that would encircle all, or substantially all, of the upper portion of the boot.

The shell is preferably molded of a dense, high-strength plastic in an injection mold. The upper portion is planar as indicated in FIGS. 6 and 7, and the lower portion descends to define a transverse stirrup 20. As seen in FIG. 2, the stirrup supports the arch of the foot, with the front portion of the shell being open to expose the toe portion 22 of the boot, and the rear portion being open to allow the heel 24 to protrude. This construction allows workmen to continue wearing the boots they were wearing when they arrived on the jobsite, rather than removing the boots, before putting on the spike mount, as they would with ski boots. This accords with the way they have been used to attaching spikes in the past.

Turning to the lower portion of the unit, the stirrup includes a rigid strap 26, preferably made of steel. This strap is also preferably largely embedded in the plastic in the shell during the molding process. It begins on the outside of the foot at 28, passes down across the arch of the foot and then back up to a considerable height on the inside of the foot as indicated 30.

A spike mount is provided in the form of a downwardly-directed socket 32 which is defined integrally with the shell. The shell is thickened around the socket area as indicated at 33 in FIG. 2 to strengthen the unit in the socket area. However, so that the strength of the plastic of the shell is not alone relied upon to mount the spike, a steel jacket 34 lines the socket as defined by the plastic of the shell. The jacket is welded or otherwise made integral with the inside portion 30 of the stirrup strap 26. The inside of the socket contacted by the spike is thus all steel.

The bottom of the stirrup is provided with a resilient pad 35 or the like. This pad not only provides friction for walking and tree-climbing, but also protects the tree from the nicks that it would be subject to using the currently popular steel spike mount.

The spikes are shown individually in FIGS. 3, 4 and 5 in their different lengths. Each spike has a pair of mounting bores 36. These bores align with similar bores in the socket 32 when the shanks 38 of the spikes 40 are individually inserted within the socket. Although a single pin or two separate pins could be used to retain the spike in place, in the preferred embodiment as shown in FIGS. 9,10A double retaining pin 42 is inserted through the bores and engaged by a clip 44, or otherwise rendered completely immobile.

The spur portion 46 of the various ones of the spikes 40 vary in extended length from one inch to two inches to accommodate trees of different bark thicknesses.

There needs to be some retaining means for holding the upper part of the shell together around the lower leg and ankle of the user. This could be provided more like the retainer of a ski boot, or like the buckles of old-fashioned galoshes. However, in the preferred embodiment belts 48 are used which pass through integrally molded belt loops 50 and terminate in quick-release friction buckles 52. These buckles have shown themselves to be very advantageous in that they are extremely secure once closed, they are infinitely adjustable, and they are quick-release.

The belts 48 would ordinarily be made of tough fabric such as nylon. The simplest means of utilizing the belts is to have them completely encircle the upper portion of the shell as shown in the Figures. However, of course an alternative would be to have two separate ends of the belt connected to rings or other structure on the sides of the shell so that the entire boot is not encircled.

Although the opening of the shell as shown at 16 in the front, conceivably it could be on one side, the outside, as well. In addition, the shell could cover the toe and/or heel of the user's foot as well, and should both toe and heel be covered, it could be designed to use to replace the footwear the worker is wearing when he comes to the jobsite. In other words, it could be more like a ski boot. In addition, rather than having an open front 16, some kind of expansible upper portion could be used such that the upper portion is merely expanded rather than being separated to insert the foot.

However, irrespective of variations of this sort, the quality of the boot is largely achieved by [having] the substantially wrap-round thoroughly padded comfortable upper portion of the boot, and the rugged stirrup structure which is integral with the spike retainer shank. This combination provides a tough, comfortable, and relatively light weight spike mount, that is infinitely adjustable insofar as the utilization of spikes of different spur lengths are concerned, and when implemented in the marketplace will represent the first breakthrough, and a major one, in spike mounting devices in over a hundred years.

It is hereby claimed:

1. A tree-climbing spike mount for mounting a tree-climbing spike to the lower leg and foot of the user, comprising:

(a) a shell, made at least partially of at least semi-flexible material for wrapping substantially around the lower leg and foot of the user and defining a stirrup to pass around the arch of the foot of the user;

(b) a layer of padding substantially covering and being bonded to the interior of at least the upper portion of said shell;

(c) retainer means to securely and releasably retain said shell around the lower leg and foot of the user; and, (d) a spike and a spike mounting socket define din said shell mounting said spike to the lower inside of said shell to enable the user to engage a tree with said spike to climb same;

(e) said stirrup including a rigid reinforcing strap to strengthen the at least semi-flexible material at said stirrup and defining a jacket lining the inside of said socket defined by said shell; and, (f) said shell being a substantially molded unit and said strap being incorporated into said molded unit during the molding process such that said shell comprises an upper at least partially flexible sheath to wrap around the lower leg of the user and depending stirrup portion with an integral, at least partially internal, rigid reinforcing strap.

2. Structure according to claim 1 wherein said strap extends laterally across the bottom portion of said stirrup and up the side thereof.

3. Structure according to claim 2 wherein said shell defines a downwardly-directed socket which comprises said spike-mounting means.

4. Structure according to claim 3 wherein said reinforcing strap extends up on the inner side of said downwardly directed socket and defines the interior wall thereof.

5. Structure according to claim 4 and including at least One spike having a shank portion which releasably seats in said socket and a downwardly directed spur portion.

* * * * *